United States Patent [19]

Alin

[11] 4,365,142

[45] Dec. 21, 1982

[54] ELECTRICAL UNIT FOR STOVES, FIREPLACES AND LIKE DEVICES

[75] Inventor: Arne Alin, Spanga, Sweden

[73] Assignee: Luftkonditionering AB, Trosa, Sweden

[21] Appl. No.: 195,438

[22] Filed: Oct. 9, 1980

[30] Foreign Application Priority Data

Oct. 18, 1979 [SE] Sweden ..... 7908663

[51] Int. Cl.[3] ..... F24H 3/04

[52] U.S. Cl. ..... 219/374; 126/120; 126/116 C

[58] Field of Search ..... 219/370, 374, 342, 343, 219/344; 126/120, 121, 116 C, 135, 136, 134, 202

[56] References Cited

U.S. PATENT DOCUMENTS

| | | | |
|---|---|---|---|
| 3,175,552 | 3/1965 | Sutton | 219/370 X |
| 3,636,307 | 1/1972 | Pearce | 219/344 X |
| 3,842,821 | 10/1974 | Juris | 219/344 X |
| 4,253,444 | 3/1981 | Johnson | 126/121 X |

*Primary Examiner*—Roy N. Envall, Jr.
*Attorney, Agent, or Firm*—Frishauf, Holtz, Goodman and Woodward

[57] ABSTRACT

An electrical heating unit comprising mainly an elongate open-ended conduit-pipe element for mounting in a stove, fireplace or like device for burning solid fuel and having a circulation or warm-air system which is separate from the combustion system of the stove, fireplace or like device. The conduit-pipe element is open at the ends thereof and encloses current supply cables for electrical heating elements arranged on the conduit-pipe element. The conduit-pipe element is also provided with a plurality of thermostats and is intended to be mounted in the flow path of the circulation air externally of the hearth space of the stove. Air forced into the conduit-pipe element at the bottom thereof and departing from the conduit-pipe element at the top thereof assists in cooling the current supply cables, even when a fire is lit in the hearth space of the stove or like device.

11 Claims, 2 Drawing Figures

ELECTRICAL UNIT FOR STOVES, FIREPLACES AND LIKE DEVICES

FIELD OF INVENTION

The present invention relates to an electrical unit for a stove, open fireplace and like heating device, in which solid fuel is burned and which have a warm-air system arranged separately from the fuel-combustion system.

BACKGROUND ART

It has previously been suggested to provide various kinds of stoves and fireplaces with electrical units, so that when the stove or fireplace is not used to heat a room with solid fuel, it can be used to heat electrically instead.

Such arrangements have hitherto been unsuccessful, however, since those electrical units previously proposed are subjected to high stresses and strains when solid fuel is burned. The heat generated in the hearth space of the stove or fireplace is very high, and since the electrical heating unit must, of necessity, be placed in the vicinity of the hearth space, it is highly difficult, among other things, to protect adequately the electrical supply cables of the unit, so as to prevent the cable casings from burning and disintegrating in the heat.

It is also difficult at times with known stove arrangements to mount the actual electrical elements effectively, and the thermostatic devices necessary to enable the electrical heating unit to function automatically.

It should be mentioned here that known to the art (e.g. from Swedish Lay-open Print No. 409,502, based on U.S. Patent Application Ser. Nos. 538,102 and 606,063 to R. M. Brown) is a heating means for open fireplaces. The internal components, and particularly the fan motor, of said heating means are cooled by air which is recirculated from the room being heated. The solution proposed in this Swedish Lay-open Print is complicated and space consuming. Moreover, cooling will not be effected efficiently if the fan breaks down.

SUMMARY OF THE INVENTION

One object of the present invention is to provide an electrical heating unit with which the problems and disadvantages inherent with known electrical heating units of the kind aforementioned are avoided.

A further object of the invention is to provide such an electrical heating unit which can be readily mounted in existing stoves, fireplaces, etc., i.e. in stoves and fireplaces which were originally only intended for solid fuels.

Another object of the invention is, alternatively, to provide such an electrical heating unit which can be mounted in a stove during the manufacture thereof, in a manner such that the retailed product affords two mutually different systems for heating the circulating air.

To these ends there is here proposed an electrical heating unit for stoves, fireplaces and like devices intended for solid fuel and having a combustion system and a warm-air circulation system arranged separately from said combustion system, said heating unit comprising electrical heating elements; current-supply cables connected to said elements; an open-ended conduit-pipe element which protectively encloses said current-supply cables and which carries said electrical heating elements; fan means arranged in said circulation system; and mounting means for so positioning said unit in the flow path of the hot air in said stove, fireplace or like device that cooling air for cooling said supply cables flows into the lower end of said conduit-pipe element as a result of convection and/or the action of said fan means, and departs at the top end of said conduit-pipe element, where it is mixed with the heated circulatory air.

The conduit-pipe element of the present invention not only serves as a mounting means for said heating elements, but also creates a cooling environment for the electric cables supplying electrical current to said elements.

In practice, the open-ended conduit-pipe element may simply comprise two profiled elements, e.g. two elongate elements of U-shaped cross-section, which have been riveted or welded together. There is no need for the conduit-pipe element to be sealed along mutually joining edges, since the cooling function of said element is fully efficient, irrespective of whether the element is sealed or not.

The electric heating elements may have the form of one or more simple coils having means by which they can be readily and positively mounted onto said conduit-pipe element.

In accordance with one embodiment of the invention, the conduit-pipe element is arranged to extend on the outside of the hearth space of the stove, between the region of the location of the fan means, located in the lower portion of the stove, and an upper outlet grid for heated air.

In this case the conduit-type element may comprise, a simple, straight elongate element which can be readily attached to the inside of the stove outer casing, so as to extend in the said manner. It will be understood, however, that the conduit-pipe element need not be straight, but may have any given shape, depending on the general design of the stove or fireplace.

To enable the electric heating unit to be controlled automatically, and to prevent overheating, the conduit-pipe element is preferably provided at the upper part thereof with at least one thermostat, which serves as an overheat safeguard, and at the lower part thereof with a thermostat which senses, either directly or indirectly, the prevailing temperature in the hearth space and when said temperature falls below a given level activates one or more of the electrical heating elements on said conduit-pipe element, provided that the room-thermostat calls for heat.

The conduit-pipe element may also have arranged at the top thereof a further thermostat for controlling said circulation fan. When the temperature of the circulation air exceeds a given level, for example the fan speed may be increased through said further thermostat.

By providing the electrical heating unit with the necessary thermostats, the installation of said unit is a very simple operation. Thus, when mounting the conduit-pipe element onto the inner wall of the stove, the cables exiting from the lower end of the conduit-pipe element need only be coupled to electrical coupling means suitably located in the stove.

According to one embodiment the lower thermostat also serves as a room-temperature control thermostat, thereby obviating the need of coupling the stove to an external thermostat.

BRIEF DESCRIPTION OF THE DRAWING

An exemplary embodiment of the invention will now be described with reference to the accompanying drawing, in which.

DETAILED DESCRIPTION

Figure 1:
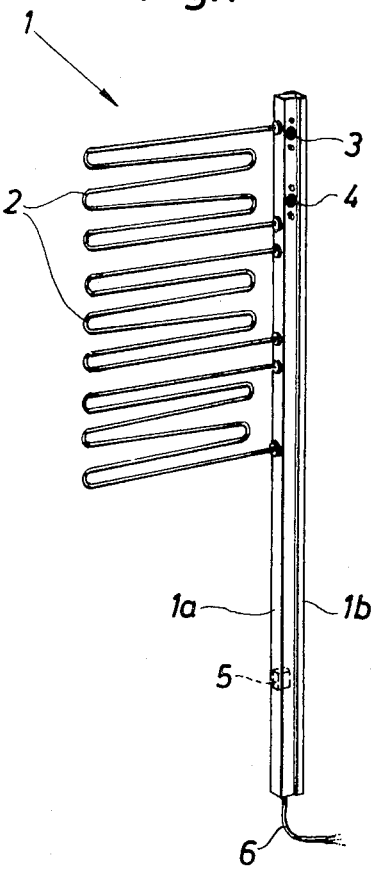
FIG. 1 is a perspective view of an electric heating device according to the invention.

In FIG.1 there is shown an electrical heating unit for a stove, fireplace or like device intended for burning solid fuel. The unit includes an elongate conduit-pipe element, generally referenced 1, comprising two metal profiles 1*a*, 1*b* which have a U-shaped cross-section and which have been joined together as by welding. The conduit-pipe element 1 may have a length of, for example, 1250 mm. In the illustrated embodiment, the conduit-pipe element 1 has mounted thereon three electrical heating elements 2, which extend substantially at right angles to said element. Arranged on the upper part of the element 1 is a first thermostat 3, which serves as an overheat safeguard, and a second thermostat 4 arranged to control the fan in the stove illustrated in FIG. 2 and described hereinafter.

Arranged on the lower part of the conduit-pipe element 1 is a third thermostat 5, which is arranged to sense the temperature of the heat radiating from the hearth space and, provided that an external room-thermostat calls for heat, to activate one or more of the heating elements 2, when said temperature falls below a given value. In certain cases, the third thermostat 5 may be arranged to function as a room-temperature control thermostat, i.e. a thermostat operative to maintain the temperature of the room in which the stove or fireplace is located at a set level.

The cables supplying the heating elements 2 and the cables passing to respective thermostats 3, 4 and 5, extend within the conduit-pipe element 1 and exit at the bottom thereof, as shown at 6. The cables are arranged to be connected to a coupling means located in the stove in which the electrical heating unit is, or is to be, mounted.

Figure 2:
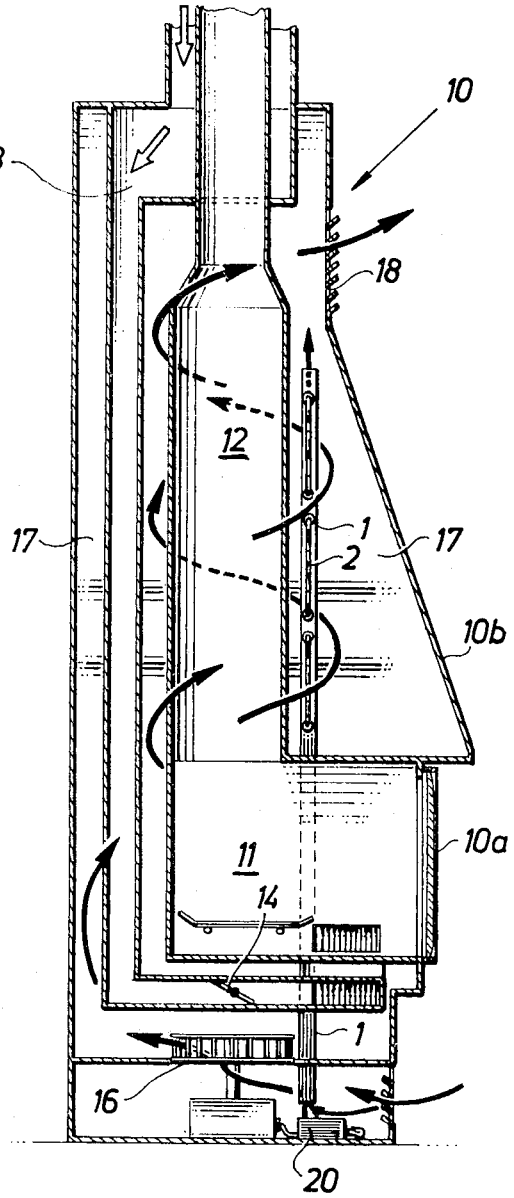
FIG. 2 illustrates the unit of FIG. 1 mounted in an otherwise known hot-air stove.

The hot-air stove illustrated in FIG. 2 is generally referenced 10. It functions with two mutually different systems, namely a fuel-combustion system and a warm-air or circulation system for room air.

The over 10 has a hearth space 11 which is sealingly closed by glass covers 10*a* and communicates with a flue duct 12. Combustion air heated by the hot stove-fumes is passed to the hearth space 11 via a passage 13, in which there is arranged a valve 14.

Air from the room in which the stove is situated is charged to the stove via an opening in the lower part thereof, and is set into motion by the fan 16. The air moves upwardly via a space 17 surrounding the hearth 11 and the fume duct 12, whereafter the thus heated air, subsequent to heat exchange, departs via an upper outlet grid 18.

Suspended in the space 17, on the inside of the forwardly inclined front plate 10*b* of the stove is a heating unit of the kind illustrated in FIG. 1, with the top of the conduit-pipe element 1 terminating immediately beneath the grid 18. As indicated, the lower part of the element 1 is located in the region of the fan 16.

When the stove is in use, irrespective of whether a solid fuel fire is lit in the hearth or whether the electrical heating elements 2 are used, a positive flow of cold air will be forced into the lower part of the conduit-pipe element 1, as a result of natural convection and/or by convection induced by the fan 16, and will depart through the top of said conduit-pipe element, thereby to provide effective cooling of the cables therewithin. As will be understood, if the fan 16 should break down, the air drawn through the conduit-pipe element by natural convection will be sufficient to effectively cool the cables. When the circulating room air is heated with the aid of the heating elements 2, the heating sequence will be controlled automatically by the thermostats 3, 4 and 5, so as to provide the best possible heat yield.

When burning solid fuel in the hearth space 11, a draught is created in the chimney connected to the stove, said chimney comprising an extension of the flue duct 12. Replacement air, required in order for the fuel to burn, is drawn in at the top of the chimney or smoke-stack via the passage 13. When the fire has burned out, no hot air will flow out through the flue duct or smoke-stack. The draught in the smoke-stack will cease, and no air will enter from outside. Since the hearth space 11 is completely closed by the glass covers 10*a*, no warm air from the house can escape through the smoke-stack. The combustion system, which is fully closed against the room in which the stove is located, balances itself out. There is no risk of carbon dioxide spreading into the room. Also, the fire in the hearth will always obtain the correct amount of combustion air.

When the fire dies down, the amount of heat radiated from the hearth space 11 to the space 17 will decrease, and after a time the temperature in the space 17 will fall to a level such as to cause the thermostat 5 to activate one or more of the heating elements 2. In this way the temperature of the warm air leaving via the grid 18 will increase which, when a given limit value is reached, causes the thermostat 4 to activate an electrical circuit for increasing the speed of the fan 16. The temperature of the warm air then drops temporarily. However, when the temperature again rises to a given limit value, the thermostat 3 will deactivate one or more of the heating elements 2, whereafter a state of equilibrium will be reached, with repeated energization and de-energization of the heating elements 2, in a manner similar to that of conventional electric stoves.

If a fresh fire is then started in the hearth of the stove, the thermostat 5 will shortly disconnect the supply of current to the electrical heating unit completely.

I claim:

1. In a solid fuel stove, fireplace or like device having a combustion system, and a warm-air circulation system arranged separately from said combustion system, said warm-air circulation system including a fan means for circulation of air to be heated, the improvement in accordance with the invention of an electrical heating unit comprising:

at least one electrical heating element;

current-supply cables connected to said at least one electrical heating element;

an open-ended, hollow conduit-pipe element which protectively encloses said current-supply cables and which carries said at least one electrical heating element, said conduit-pipe element having upper and lower open ends; and mounting means for so positioning said conduit-pipe element in the flow path of the hot air in said stove, fireplace or like device that cooling air for cooling said supply cables flows into the lower open end of said conduit-pipe element, as a result of induced convection as a result of action of said fan means, and departs at the upper open end of said conduit-pipe element, where it is mixed with heated air in said warm-air circulation system of said stove, fireplace or like device.

2. In the stove, fireplace or like device according to claim 1, in which said fan means is in the lower part thereof and having a hearth space, the further improvement wherein said conduit-pipe element is arranged to extend up along the outside of said hearth space between the region of said fan means in the lower part of said stove and an upper hot-air outlet grid of the stove.

3. In the stove, fireplace or like device according to claim 1, in which a hearth space is provided, the further improvement wherein said conduit-pipe element comprises:

at least one thermostat arranged in the upper portion thereof and being operative as an overheat safeguard; and at least one further thermostat arranged on the lower portion of said conduit-pipe element and being operative to sense the prevailing temperature of the hearth space, either directly or indirectly, and to activate said at least one electrical heating element when the sensed temperature falls below a given limit value, provided that heat is called for in the locale being heated.

4. In the stove, fireplace or like device according to claim 3, the further improvement in which the conduit-pipe element has on its upper portion at least one further thermostat for controlling said fan means.

5. In the stove, fireplace or like device according to claim 3, the further improvement in which the lower thermostat also functions as a room-temperature control thermostat.

6. In a solid-fuel stove having a fuel-combustion system; a hot-air circulation system arranged separately from said fuel-combustion system; fan means incorporated in said circulation system in the lower region of said stove; hot-air outlet means arranged in the upper region of said stove; a hearth space located between said fan means and said hot-air outlet means; and electrical connection means;

the improvement comprising:

an electrical heating unit having at least one electrical heating element mounted thereon;

at least one current supply cable connected to said at least one electrical heating element;

an open-ended, hollow conduit-pipe element protectively enclosing said at least one current supply cable, said conduit-pipe element having upper and lower open ends; and mounting means for so positioning said conduit-pipe element in the path of a positive flow of cooling air that said cooling air passes through said conduit-pipe means, from the lower open end thereof to the upper open end thereof, to thereby cool said at least one cable enclosed by said conduit-pipe element.

7. In a solid fuel stove, fireplace or like device having a combustion system, and a warm-air circulation system arranged separately from said combustion system, the improvement in accordance with the invention of an electrical heating unit comprising:

at least one electrical heating element;

current-supply cables connected to said at least one electrical heating element;

an open-ended, hollow conduit-pipe element which protectively encloses said current-supply cables and which carries said at least one electrical heating element, said conduit-pipe element having upper and lower open ends; and mounting means for so positioning said conduit-pipe element in the flow path of the hot air in said stove, fireplace or like device that cooling air for cooling said supply cables flows into the lower open end of said conduit-pipe element, as a result of natural convection, and departs at the upper open end of said conduit-pipe element, where it is mixed with heated air in said warm-air circulation system of said stove, fireplace or like device.

8. In the stove, fireplace or like device according to claim 7, in which a hearth space is provided, the further improvement wherein said conduit-pipe element is arranged to extend up along the outside of said hearth space between the region of the lower part of said stove and an upper hot-air outlet grid of the stove.

9. In the stove, fireplace or like device according to claim 7, in which a hearth space is provided, the further improvement wherein said conduit-pipe element comprises:

at least one thermostat arranged in the upper portion thereof and being operative as an overheat safeguard; and at least one further thermostat arranged on the lower portion of said conduit-pipe element and being operative to sense the prevailing temperature of the hearth space, either directly or indirectly, and to activate said at least one electrical heating element when the sensed temperature falls below a given limit value, provided that heat is called for in the locale being heated.

10. In the stove, fireplace or like device according to claim 9, the further improvement in which the lower thermostat also functions as a room-temperature control theremostat.

11. In a solid-fuel stove having a fuel-combustion system; a hot-air circulation system arranged separately from said fuel-combustion system; air inlet means in said circulation system in the lower region of said stove; hot-air outlet means arranged in the upper region of said stove; a hearth space located between said air inlet means and said hot-air outlet means; and electrical connection means;

the improvement comprising:

an electrical heating unit having at least one electrical heating element mounted thereon;

at least one current supply cable connected to said at least one electrical heating element;

an open-ended, hollow conduit-pipe element protectively enclosing said at least one current supply cable, said conduit-pipe element having upper and lower open ends; and mounting means for so positioning said conduit-pipe element in the path of a positive flow of cooling air that said cooling air passes through said conduit-pipe means, from the lower open end thereof to the upper open end thereof, to thereby cool said at least one cable enclosed by said conduit-pipe element.

* * * * *